US010115508B2

(12) United States Patent
Kim et al.

(10) Patent No.: US 10,115,508 B2
(45) Date of Patent: Oct. 30, 2018

(54) MAGNETIC-DIELECTRIC COMPOSITE FOR HIGH-FREQUENCY ANTENNA SUBSTRATE AND MANUFACTURING METHOD THEREFOR

(71) Applicants: LG ELECTRONICS INC., Seoul (KR); INDUSTRY-UNIVERSITY COOPERATION FOUNDATION HANYANG UNIVERSITY ERICA CAMPUS, Ansan-si, Gyeonggi-do (KR)

(72) Inventors: Jinbae Kim, Seoul (KR); Yongho Choa, Ansan-si (KR); Jongryoul Kim, Ansan-si (KR); Hyoryoung Lim, Ansan-si (KR)

(73) Assignees: LG ELECTRONICS INC., Seoul (KR); INDUSTRY-UNIVERSITY COOPERATION FOUNDATION HANYANG UNIVERSITY ERICA CAMPUS, Ansan-si (KR)

( * ) Notice: Subject to any disclaimer, the term of this patent is extended or adjusted under 35 U.S.C. 154(b) by 0 days.

(21) Appl. No.: 15/526,958

(22) PCT Filed: Jun. 24, 2015

(86) PCT No.: PCT/KR2015/006449
§ 371 (c)(1),
(2) Date: May 15, 2017

(87) PCT Pub. No.: WO2016/080619
PCT Pub. Date: May 26, 2016

(65) Prior Publication Data

US 2017/0323710 A1 Nov. 9, 2017

(30) Foreign Application Priority Data

Nov. 21, 2014 (KR) ..... 10-2014-0163808

(51) Int. Cl.
*H01Q 1/00* (2006.01)
*H01F 1/147* (2006.01)
(Continued)

(52) U.S. Cl.
CPC ..... *H01F 1/14708* (2013.01); *H01Q 1/243* (2013.01); *H01Q 1/38* (2013.01); *H01Q 9/0485* (2013.01); *H01Q 9/16* (2013.01)

(58) Field of Classification Search
None
See application file for complete search history.

(56) References Cited

U.S. PATENT DOCUMENTS

2005/0164035 A1* 7/2005 Lee ..... G11B 5/855 428/823
2013/0317421 A1* 11/2013 Choi ..... H01Q 1/22 604/66
(Continued)

FOREIGN PATENT DOCUMENTS

JP 2007-149757 A 6/2007
KR 10-2005-0062026 A 6/2005
(Continued)

OTHER PUBLICATIONS

Carignan et al., "Ferromagnetic Nanowire Metamaterials: Theory and Applications," IEEE Transactions on Microwave Theory and Techniques, vol. 59, No. 10, Oct. 2011, pp. 2568-2586, XP055146881.
(Continued)

*Primary Examiner* — Trinh Dinh
(74) *Attorney, Agent, or Firm* — Birch, Stewart, Kolasch & Birch, LLP

(57) ABSTRACT

The present invention relates to a magnetic-dielectric composite for a high-frequency antenna substrate, and a manufacturing method therefor, the composite comprising: a porous insulating dielectric substrate including an upper
(Continued)

surface, a lower surface and lateral surfaces, and having a plurality of pores penetrating the upper surface and the lower surface; and soft ferrite nano-wires provided within the pores, wherein the soft ferrite nano-wires are encompassed by the insulating dielectric substrate so as to be separated from each other. The present invention controls a dielectric constant and can minimize eddy current loss by having a structure in which the soft ferrite nano-wires are provided within the pores of the insulating dielectric substrate and in which the soft ferrite nano-wires are encompassed by the insulating dielectric substrate so as to be separated from each other.

20 Claims, 20 Drawing Sheets

(51) Int. Cl.

| | |
|---|---|
| ***H01Q 9/04*** | (2006.01) |
| ***H01Q 1/24*** | (2006.01) |
| ***H01Q 1/38*** | (2006.01) |
| ***H01Q 9/16*** | (2006.01) |

(56) References Cited

U.S. PATENT DOCUMENTS

2014/0286817 A1* 9/2014 Kim ..... C23C 18/1635 419/38
2016/0172085 A1* 6/2016 Arnold ..... H01F 10/007 438/3

FOREIGN PATENT DOCUMENTS

KR 10-0822745 B1 4/2008
KR 10-2010-0101804 A 9/2010
KR 10-1367374 B1 3/2014

OTHER PUBLICATIONS

Darques et al., "Microwave circulator based on ferromagnetic nanowires in an alumina template," Nanotechnology, vol. 21, 145208, Mar. 16, 2010, pp. 1-4, XP020174752.

* cited by examiner

【FIG. 1】
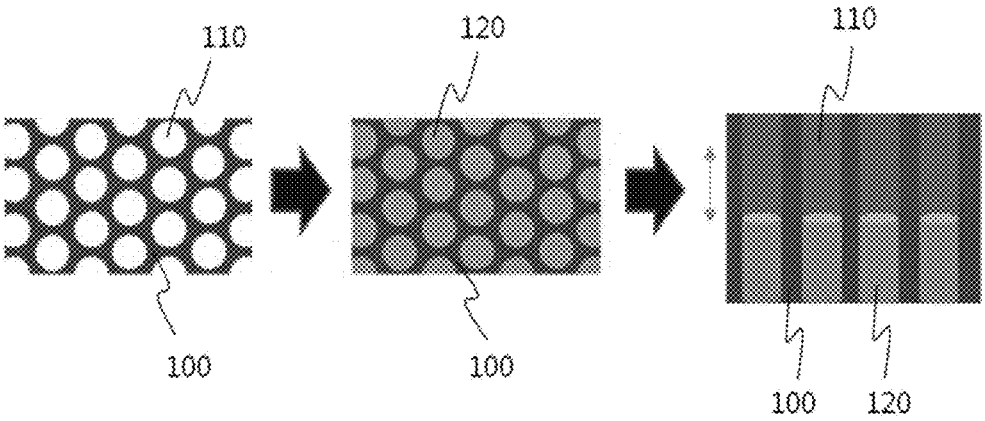

【FIG. 2】
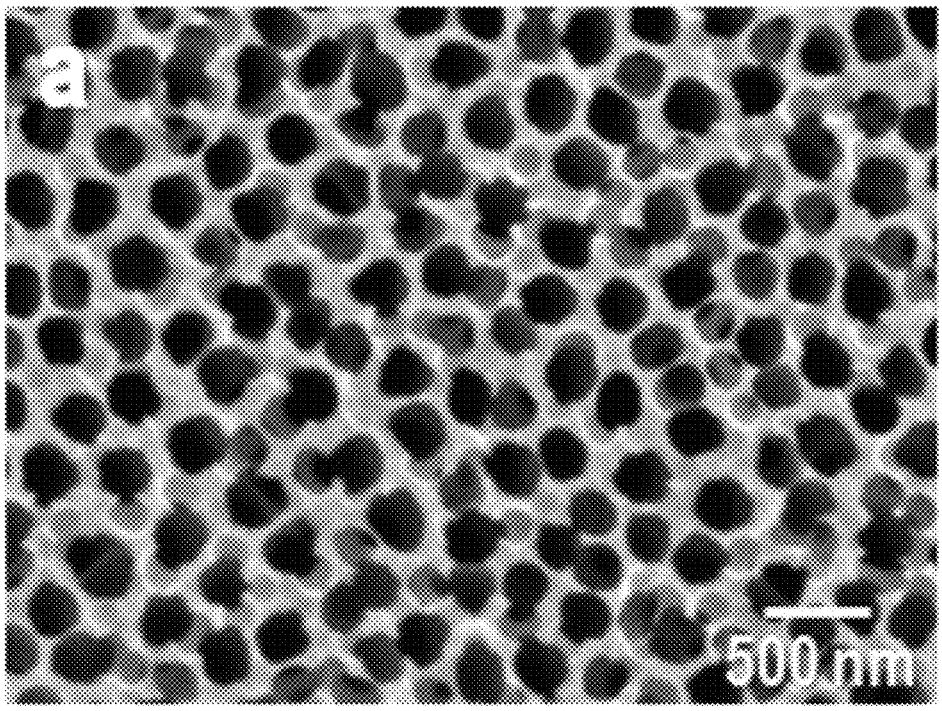

【FIG. 3】
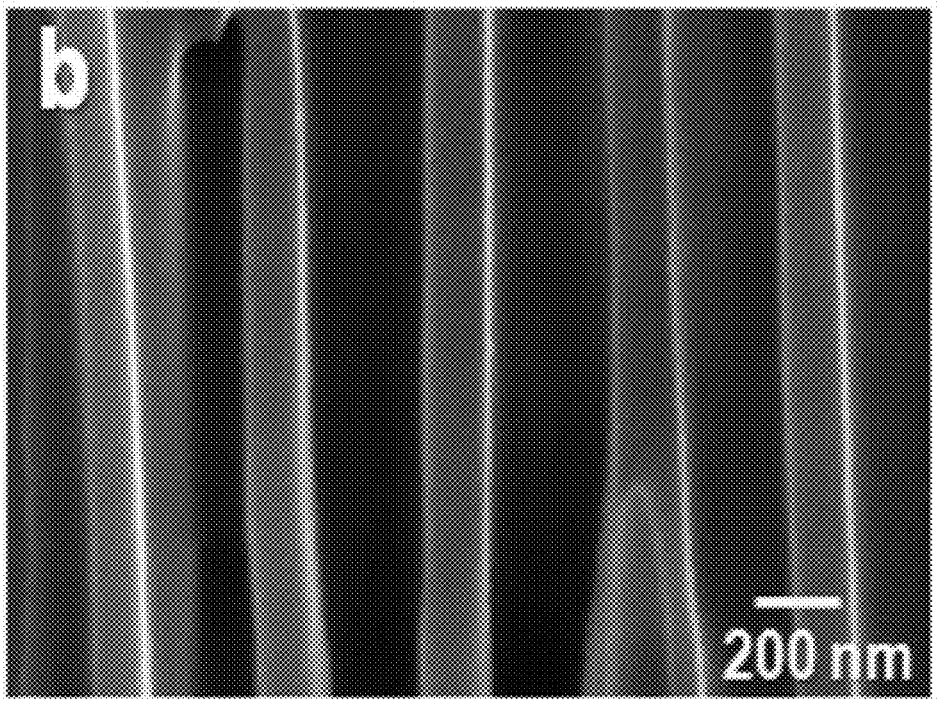

【FIG. 4】
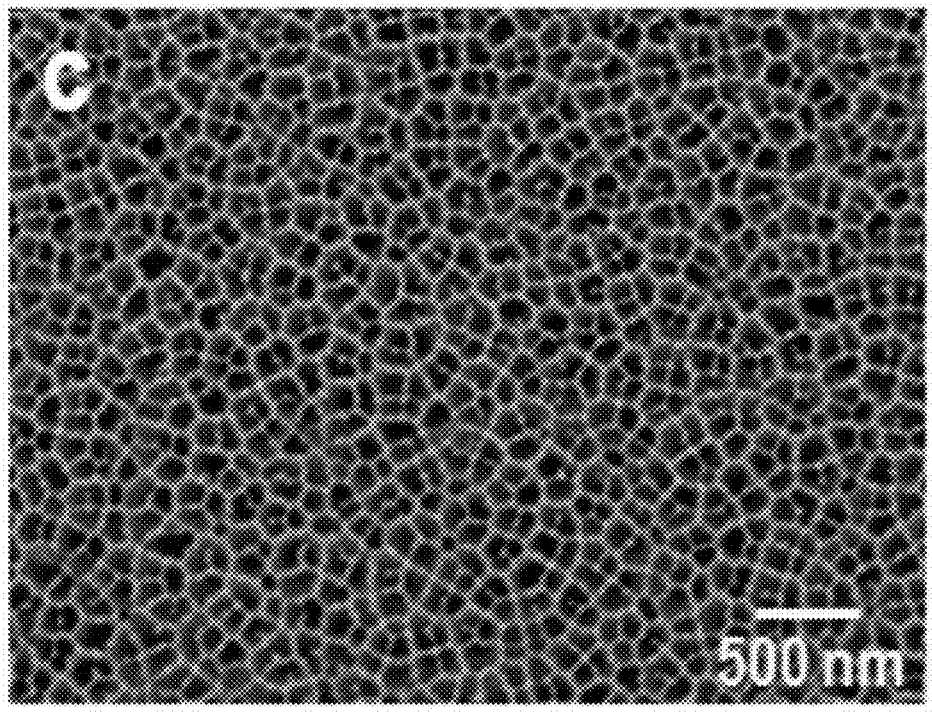

【FIG. 5】
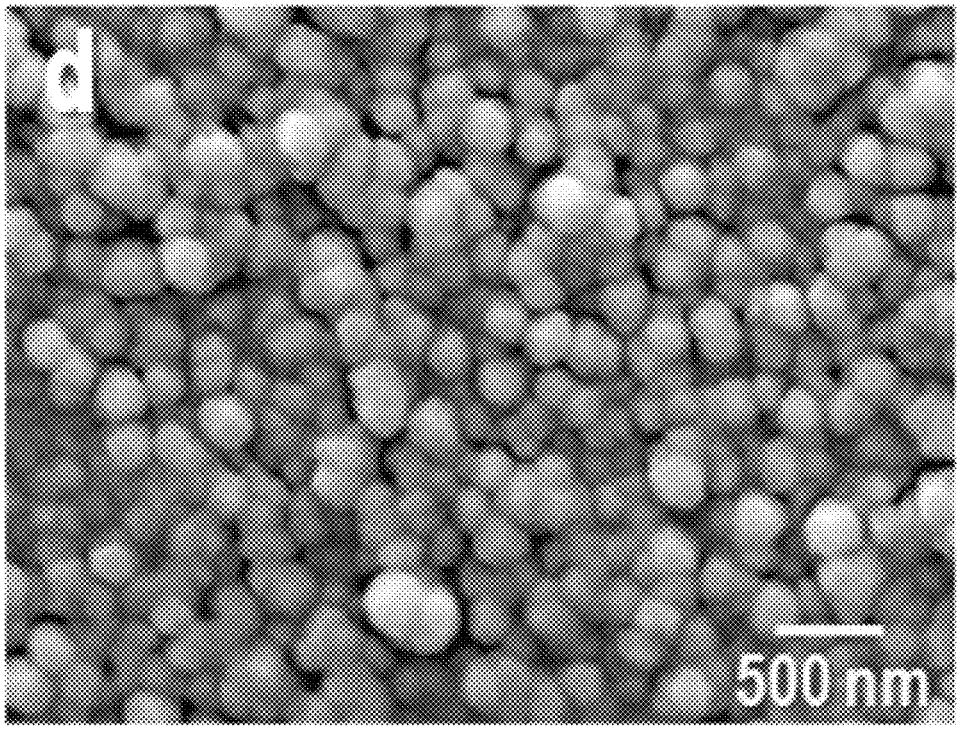

【FIG. 6】
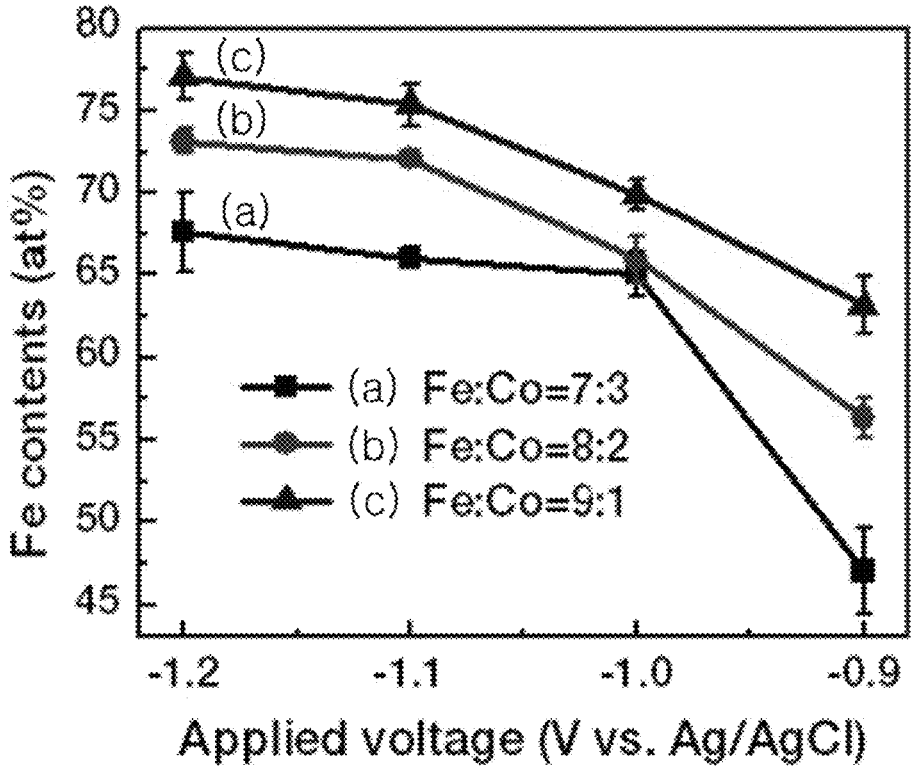

【FIG. 7】
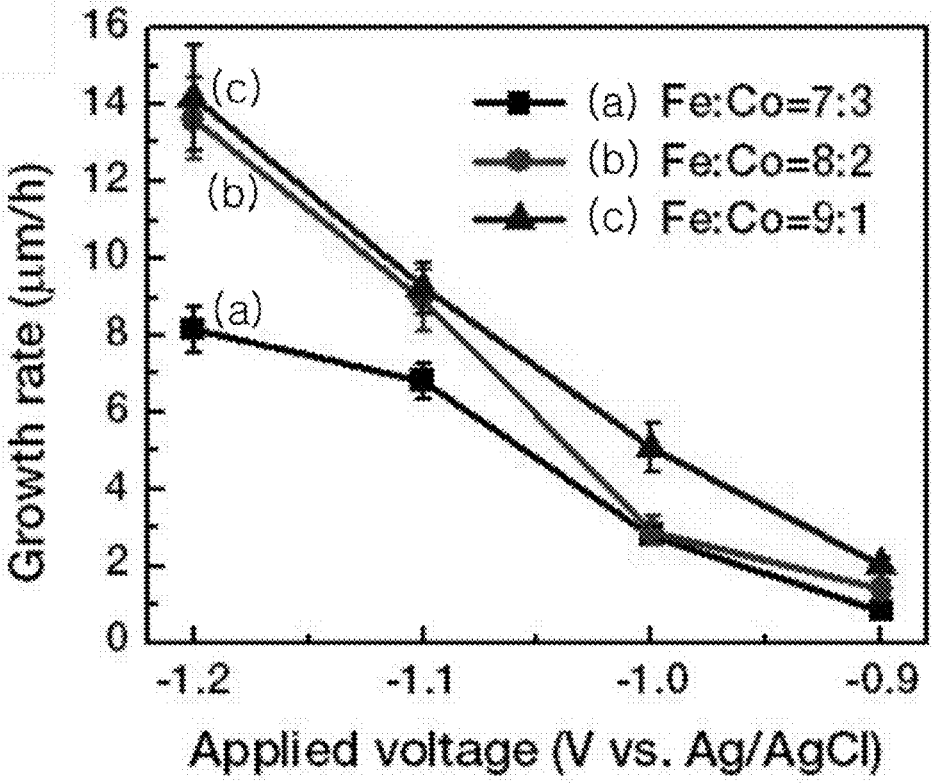

【FIG. 8】
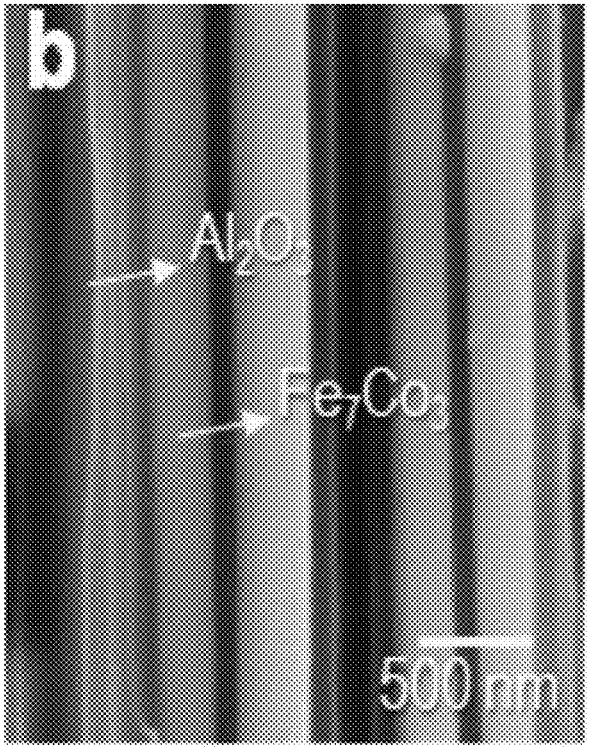

【FIG. 9】
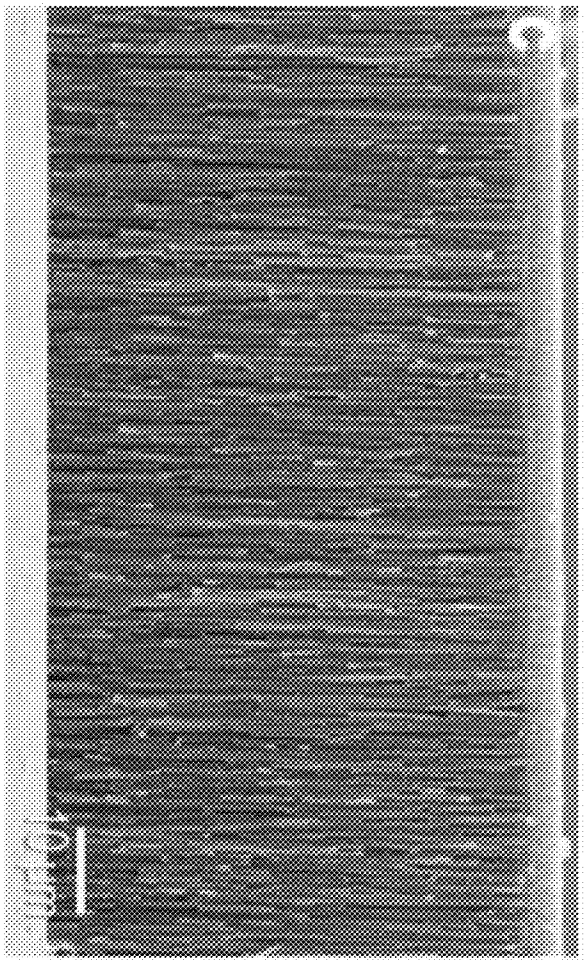

【FIG. 10】
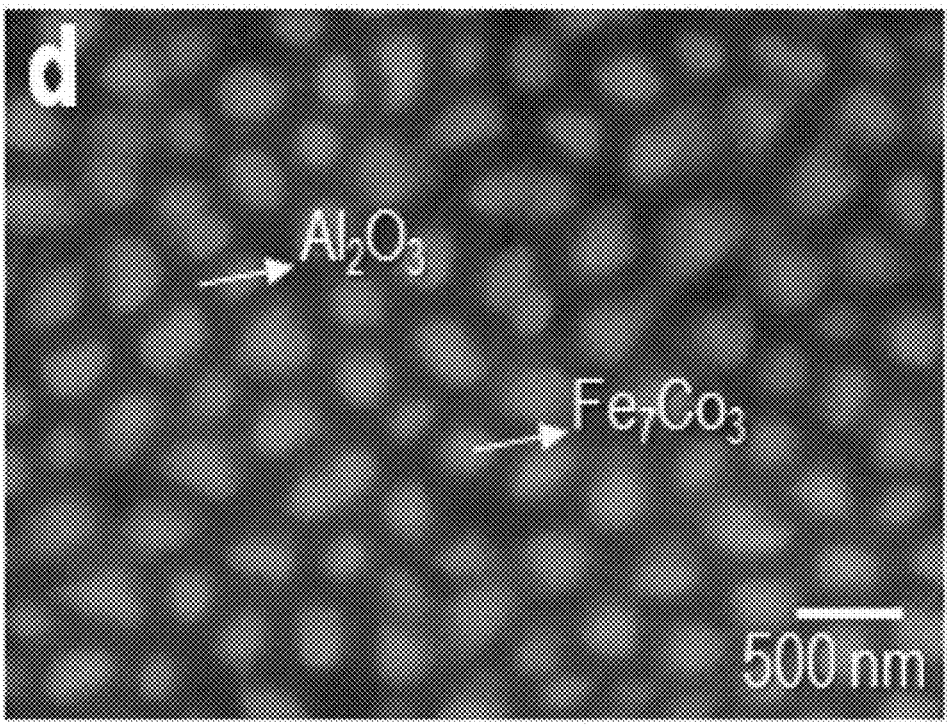

【FIG. 11】
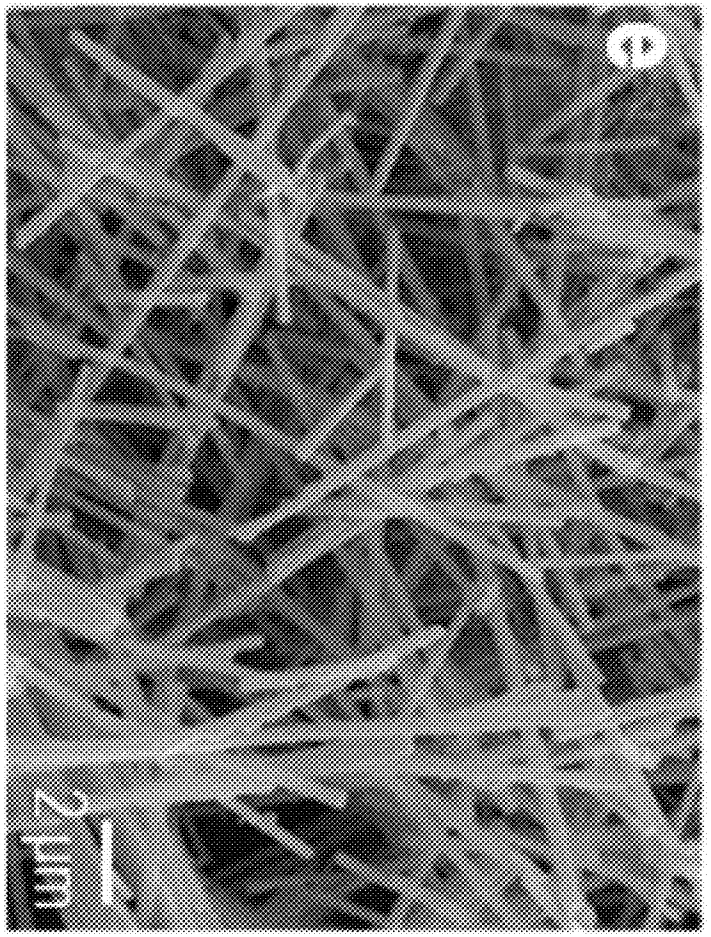

【FIG. 12】
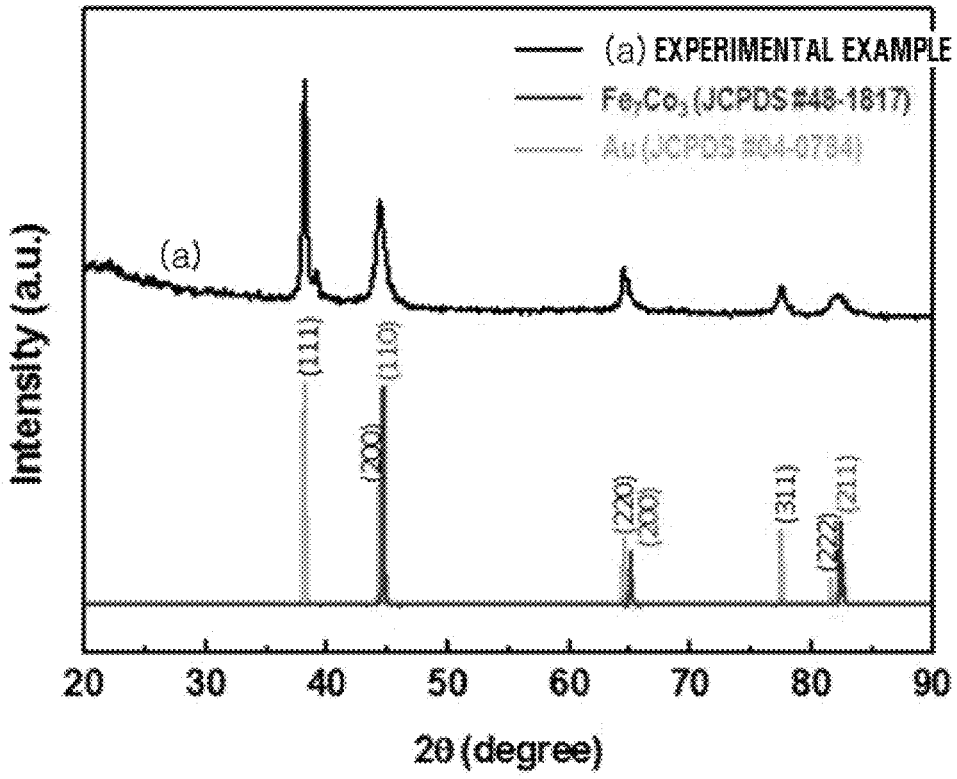

【FIG. 13】
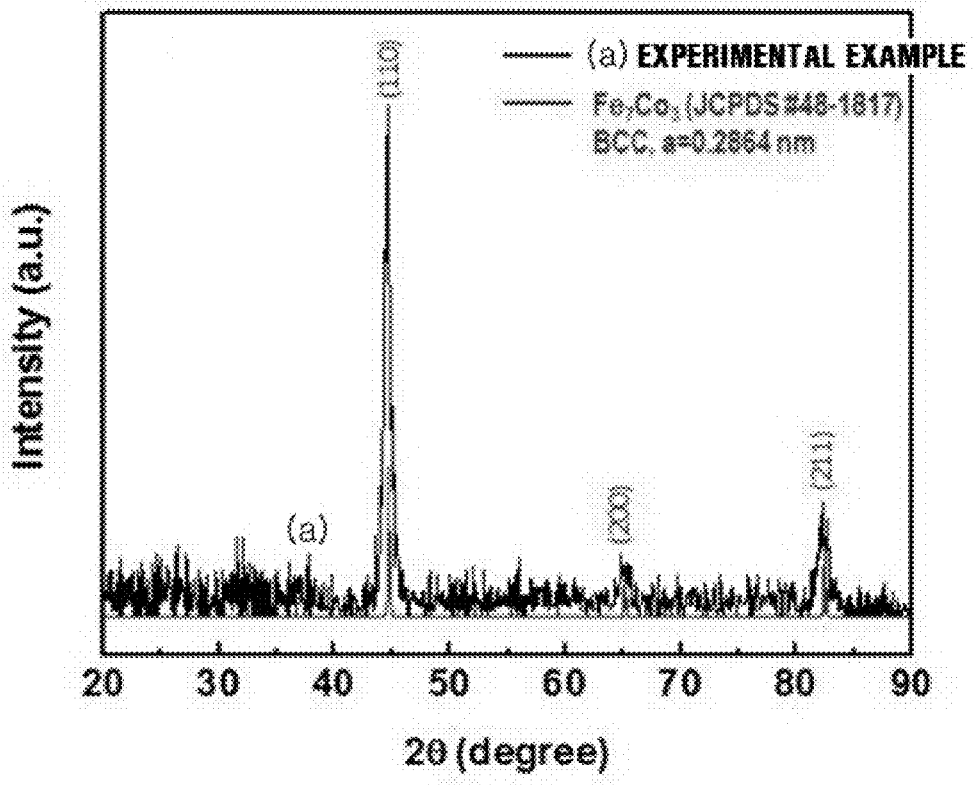

【FIG. 14】
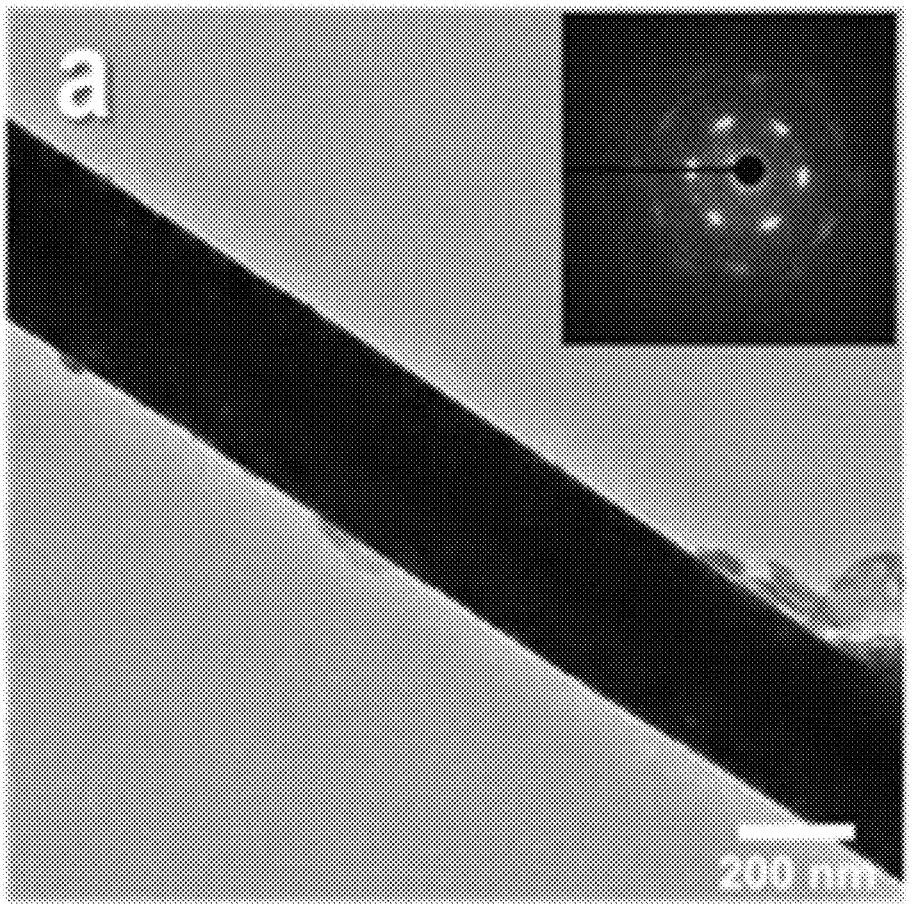

【FIG. 15】
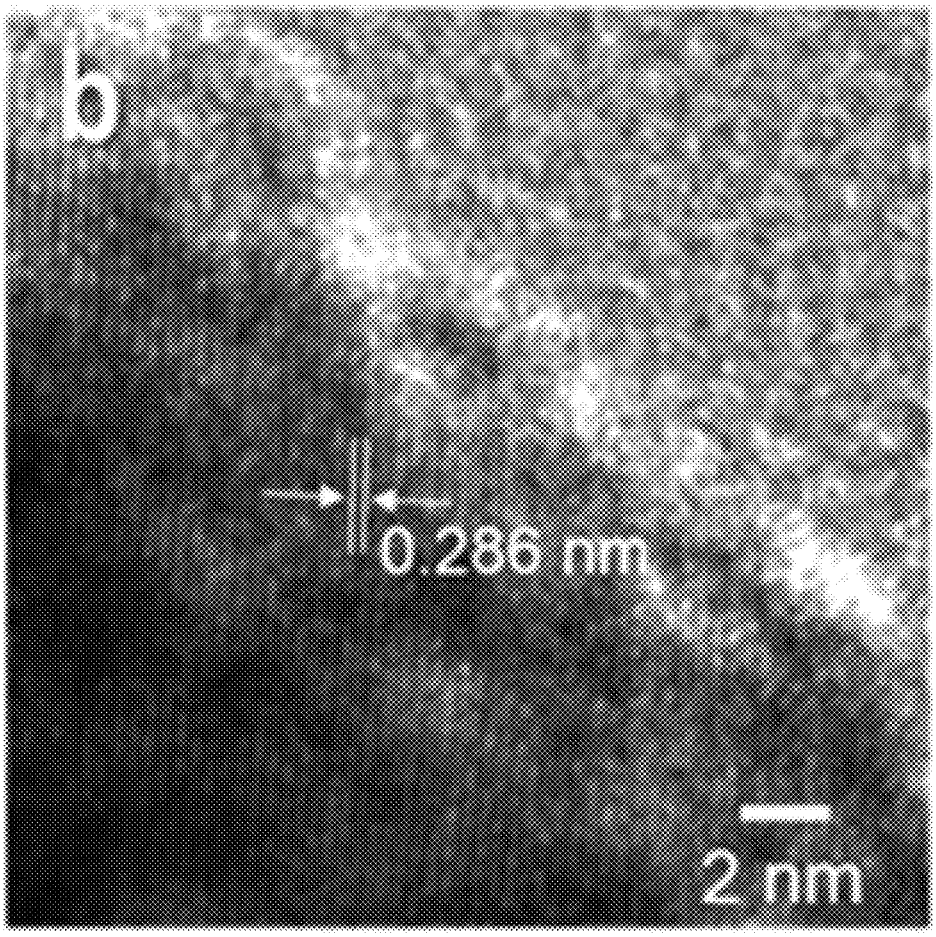

【FIG. 16】
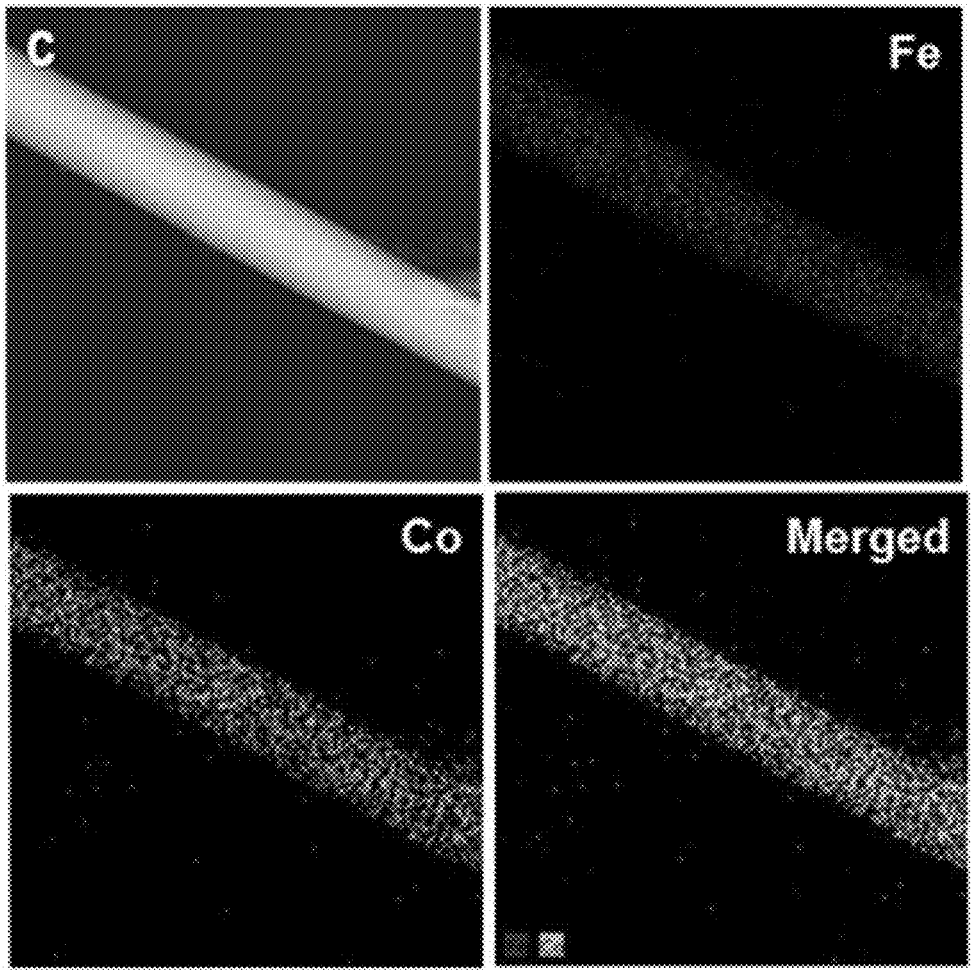

【FIG. 17】
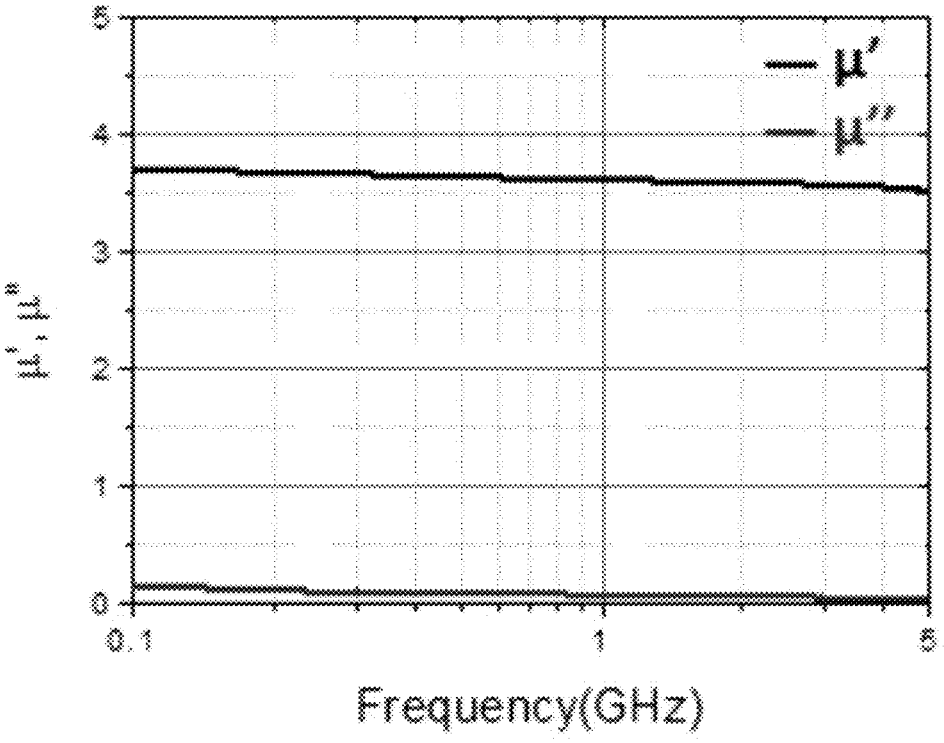

【FIG. 18】
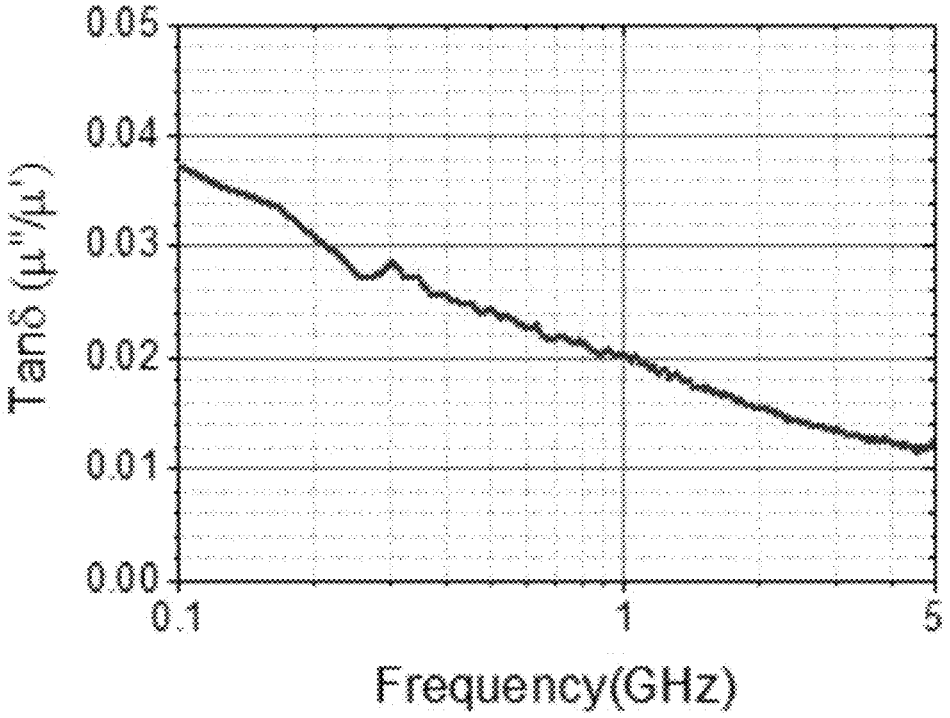

【FIG. 19】
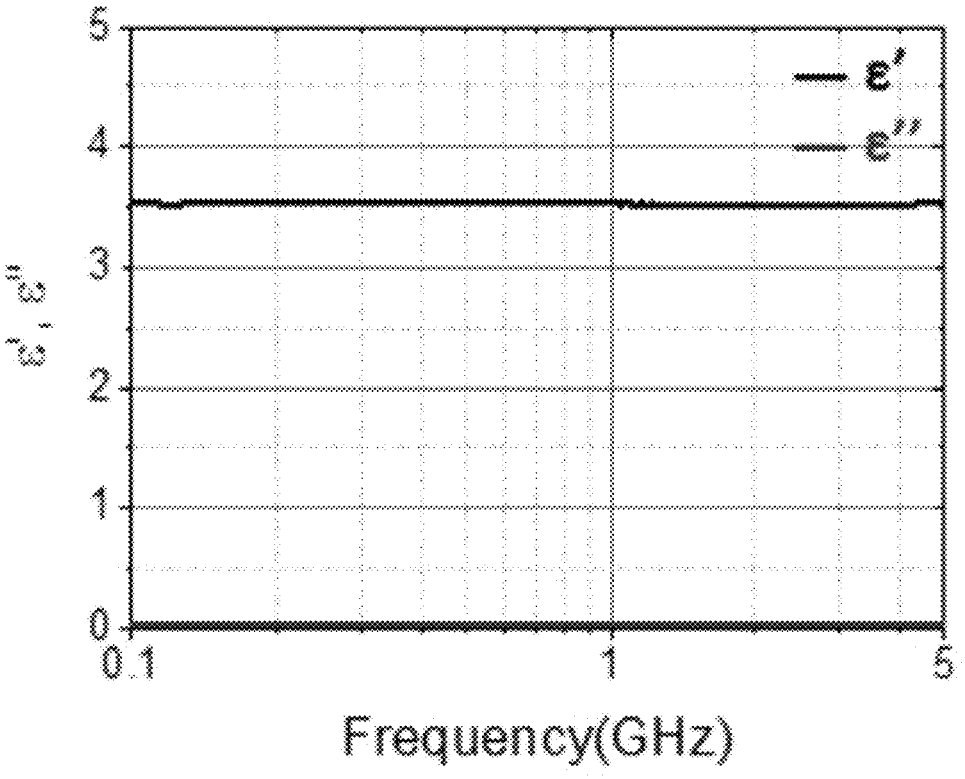

【FIG. 20】
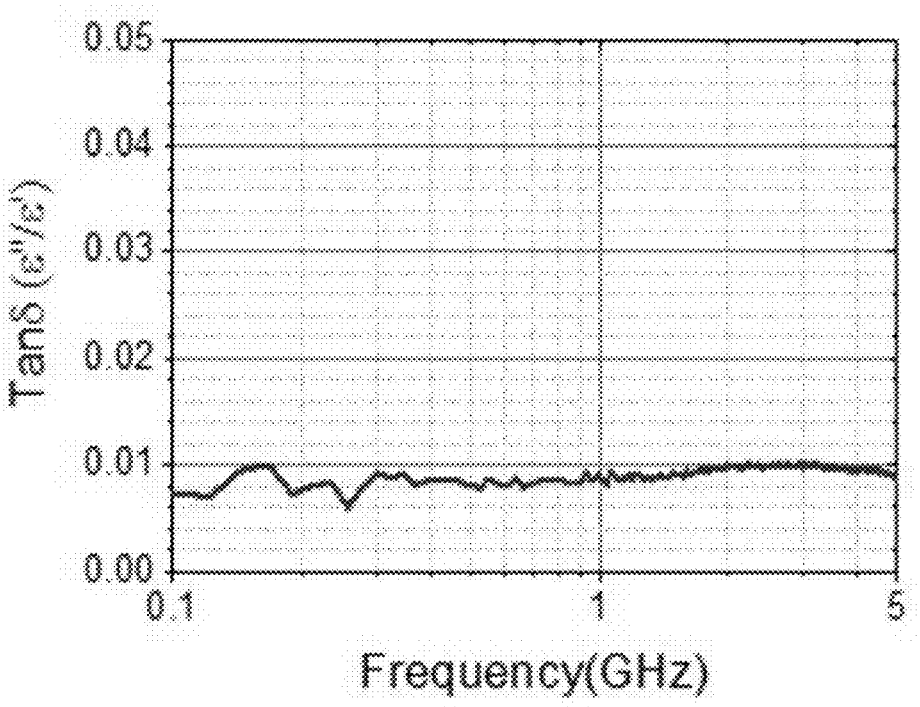

MAGNETIC-DIELECTRIC COMPOSITE FOR HIGH-FREQUENCY ANTENNA SUBSTRATE AND MANUFACTURING METHOD THEREFOR

CROSS REFERENCE TO RELATED APPLICATIONS

This application is the National Phase of PCT International Application No. PCT/KR2015/006449, filed on Jun. 24, 2015, which claims priority under 35 U.S.C. 119(a) to Patent Application No. 10-2014-0163808, filed in Republic of Korea on Nov. 21, 2014, all of which are hereby expressly incorporated by reference into the present application.

TECHNICAL FIELD

The present invention relates to a magnetic-dielectric composite for an antenna substrate and a manufacturing method thereof, and more particularly, to a magnetic-dielectric composite for a high-frequency antenna substrate, which is provided with soft magnetic material nanowires in pores of an insulating dielectric substrate, in which the soft magnetic material nanowires are capable of controlling the permittivity and minimizing the eddy current loss by having a structure in which the soft magnetic material nanowires are spaced apart from each other while being surrounded by the insulating dielectric substrate, and a manufacturing method thereof.

BACKGROUND ART

An antenna for mobile communication is a device that transmits and receives date by mutually converting electric power and radio frequency energy, and recently, studies on improving the transmission quality and implementing miniaturization of a mobile device have been actively conducted in order to satisfy rapidly increasing amounts of data communication.

An operating frequency band for securing the quality of transmitting and receiving data is planned to increase from 0.8 to 2.1 GHz to 5 GHz by 2020. Accordingly, it is expected that the demand for microstrip antenna devices available in a wide bandwidth including super high frequency (SHF) is increased. Due to advantages in that the microstrip antenna is lightweight, easily manufactured, and suitable for mass production, and easily implements an array antenna, the microstrip antenna has been currently used in various fields over the radio frequency (RF), starting from the application to the spaceship field in the early 1970s. In particular, when a high permittivity and high permeability substrate, which replaces a printed circuit board (PCB) and a dielectric material, is used, the substrate for use in a mobile phone operating in a high frequency band is used in various cases.

In order to make a wireless transmission magnetic device small, enhance the performance of the wireless transmission magnetic device, and increase the operating frequency stability, soft magnetic materials having excellent high frequency characteristics are required. Further, due to the development of information communication, various bands and a broad bandwidth need to be simultaneously used instead of an existing single band in a high frequency region, and as the device becomes smaller, characteristics of the soft magnetic material are also required at a higher level. The soft magnetic material basically needs to have excellent permeability and saturation magnetization, high electric resistance and low coercive force characteristics and low eddy current loss characteristics are required. Since a metal-based soft magnetic material such as Fe, Co, Ni, or permalloy ($Fe_xNi_{1-x}$ (X is a real number less than 1)) has a low electric resistance, the eddy current loss is high, and as a result, there is a problem in that the permeability is sharply decreased in a high frequency band in the GHz region. Accordingly, for the application in a high frequency region, the permeability may be maintained only when the material needs to decrease the eddy current loss by having a high electric resistance. Due to the disadvantages of the metal-based soft magnetic material, a ferrite ($MFe_2O_4$)-based material having high electric resistance in a high frequency region is usually used. Currently, a ferrite-based material having high resistivity has been usually used in antenna for mobile communication operating in a band between several MHz and 1 GHz, but the ferrite-based material has a limitation in being used in a frequency band of 1 GHz or more because the volume is increased due to the small saturation magnetization value.

DISCLOSURE OF THE INVENTION

Therefore, an object of the present invention is to provide a magnetic-dielectric composite for a high-frequency antenna substrate, which is provided with soft magnetic material nanowires in pores of an insulating dielectric substrate, in which the soft magnetic material nanowires are capable of controlling the permittivity and minimizing the eddy current loss by having a structure in which the soft magnetic material nanowires are spaced apart from each other while being surrounded by the insulating dielectric substrate, and a manufacturing method thereof.

To achieve these and other advantages and in accordance with the purpose of the present invention, as embodied and broadly described herein, there is provided a magnetic-dielectric composite for a high-frequency antenna substrate, the composite including: a porous insulating dielectric substrate including an upper surface, a lower surface, and a side surface and provided with a plurality of pores penetrating the upper surface and the lower surface; and soft magnetic material nanowires provided in the pores, in which the soft magnetic material nanowires are spaced apart from each other while being surrounded by the insulating dielectric substrate.

The magnetic-dielectric composite for a high-frequency antenna substrate may be used as an antenna substrate for mobile communication in a high frequency band of 0.1 to 5 GHz.

The soft magnetic material nanowire may be a metal-based soft magnetic material including Fe, Co, Ni, $Fe_xNi_{1-x}$ (X is a real number less than 1), $Fe_xCo_{1-x}$ (X is a real number less than 1), or $Co_xNi_{1-x}$ (X is a real number less than 1).

It is preferred that the pores have an average diameter of 10 to 500 nm, and the soft magnetic material nanowires have an average diameter of 10 to 500 nm.

It is preferred that the insulating dielectric substrate has a thickness between the upper surface and the lower surface of 10 to 300 μm, and a length of the soft magnetic material nanowire is smaller than a thickness of the insulating dielectric substrate.

The insulating dielectric substrate may be a substrate including one or more oxides selected from alumina ($Al_2O_3$), titania ($TiO_2$), zirconia ($ZrO_2$), and niobium oxide ($Nb_2O_5$).

Further, the present invention provides a method for manufacturing a magnetic-dielectric composite for a high-frequency antenna substrate, the method including: preparing a porous insulating dielectric substrate including an upper surface, a lower surface, and a side surface and provided with a plurality of pores penetrating the upper surface and the lower surface; covering a plurality of pores on the lower surface by forming a seed layer having electric conductivity on the lower surface of the insulating dielectric substrate; growing and forming soft magnetic material nanowires by means of electrodeposition on the seed layer exposed through a plurality of pores on the entire surface of the insulating dielectric substrate; and removing the seed layer, in which the soft magnetic material nanowires are spaced apart from each other while being surrounded by the insulating dielectric substrate.

The preparing of the porous insulating dielectric substrate may include forming a substrate including one or more oxides selected from porous alumina ($Al_2O_3$), titania ($TiO_2$), zirconia ($ZrO_2$), and niobium oxide ($Nb_2O_5$) by anodizing one or more metal substrates selected from aluminum (Al), titanium (Ti), zirconium (Zr), and niobium (Nb), oxalic acid, phosphoric acid, sulfuric acid, or a mixed solution thereof may be used during the anodization of aluminum (Al), hydrofluoric acid, boric acid, sulfuric acid, phosphoric acid, or a mixed solution of phosphoric acid and calcium may be used during the anodization of titanium (Ti), boric acid, nitric acid, sulfuric acid, or a mixed solution of sulfuric acid and sodium fluoride may be used during the anodization of zirconium (Zr), and sulfuric acid, phosphoric acid, a mixed solution of sulfuric acid and hydrofluoric acid, or a mixed solution of phosphoric acid and hydrofluoric acid may be used during the anodization of niobium (Nb).

The insulating dielectric substrate may be a substrate including one or more oxides selected from alumina ($Al_2O_3$), titania ($TiO_2$), zirconia ($ZrO_2$), and niobium oxide ($Nb_2O_5$), widening pores with respect to pores of the porous insulating dielectric substrate may be further included, and it is preferred that the pores of the porous insulating dielectric substrate are allowed to have a size of 10 to 500 nm by the pore-widening.

The pore-widening may be carried out by a method of dipping a porous insulating dielectric substrate in a sodium hydroxide (NaOH) solution, a phosphoric acid ($H_3PO_4$) solution, or a mixed solution of phosphoric acid ($H_3PO_4$) and chromic acid ($H_2CrO_4$) when the insulating dielectric substrate is a substrate including alumina ($Al_2O_3$), and it is preferred that the porous insulating dielectric substrate is adjusted so as to have a porosity of 10 to 73% by the pore-widening.

The soft magnetic material nanowire may be a metal-based soft magnetic material including Fe, Co, Ni, $Fe_xNi_{1-x}$ (X is a real number less than 1), $Fe_xCo_{1-x}$ (X is a real number less than 1), or $Co_xNi_{1-x}$ (X is a real number less than 1).

The electrodeposition may use an electrolytic solution including a soft magnetic material precursor and acid or base, iron(II) sulfate heptahydrate ($FeSO_4.7H_2O$), iron(II) chloride tetrahydrate ($FeCl_4.4H_2O$), iron(II) fluoborate, or a mixture thereof may be used as an Fe precursor, cobalt(II) chloride hexahydrate ($CoCl_2.6H_2O$), cobalt(II) sulfate heptahydrate ($CoSO_4.7H_2O$), or a mixture thereof may be used as a Co precursor, and nickel(II) sulfate hexahydrate ($NiSO_4.6H_2O$), nickel(II) chloride hexahydrate ($NiCl_2.6H_2O$), or a mixture thereof may be used as a Ni precursor.

It is preferred that the seed layer is attached to an working electrode to electrically connect the attached seed layer to a negative electrode, and to connect a counter electrode including a metal which is different from the seed layer and the soft magnetic material to a positive electrode, and a negative voltage is applied to the negative electrode to form soft magnetic material nanowires including Fe, Co, Ni, $Fe_xNi_{1-x}$ (X is a real number less than 1), $Fe_xCo_{1-x}$ (X is a real number less than 1) or $Co_xNi_{1-x}$ (X is a real number less than 1) in pores of an insulating dielectric substrate.

It is preferred that the pores are formed to have an average diameter of 10 to 500 nm, and it is preferred that the soft magnetic material nanowires provided in the pores are formed to have an average diameter of 10 to 500 nm.

The insulating dielectric substrate may have a thickness between the upper surface and the lower surface of 10 to 300 μm, and it is preferred that a length of the soft magnetic material nanowire is formed to be smaller than a thickness of the insulating dielectric substrate.

It is preferred that the seed layer is formed to have a thickness of 5 to 1,000 nm, and it is preferred that the seed layer uses one or more metals selected from gold (Au), platinum (Pt), silver (Ag), and copper (Cu), which are different from the components of the soft magnetic material nanowires.

According to the present invention, metal-based soft magnetic material nanowires are provided in a porous insulating dielectric substrate and the soft magnetic material nanowires have a structure in which the soft magnetic material nanowires are spaced apart from each other while being surrounded by the insulating dielectric substrate, thereby overcoming advantages of an existing metal-based soft magnetic material, controlling the permittivity, and minimizing the eddy current loss, and the soft magnetic material nanowires may be used as an antenna substrate for mobile communication in a high frequency band of 0.1 to 5 GHz by generating the ferromagnetic resonance (FMR) in a band of 5 GHz or more.

The soft magnetic material nanowires are surrounded by an insulating dielectric material without being brought into contact with each other, and have a structure capable of minimizing the eddy current loss. The porous insulating dielectric substrate serves as a dielectric material which controls the permittivity and simultaneously functions as an insulating material which prevents the eddy current loss of the soft magnetic material. Since the eddy current loss may be minimized, it is possible to suppress a problem in that the permeability is decreased in a band of 0.1 to 5 GHz. A magnetic-dielectric composite for a high-frequency antenna substrate is stable in a high frequency band of 0.1 to 5 GHz, and has a high permeability and a high permittivity.

Since the magnetic-dielectric composite can be used as a material for an antenna substrate in a high frequency region of 100 MHz to 5 GHz, it is possible to make mobile devices smaller and secure amounts of data communication and the quality.

An insulating dielectric material which constitutes a porous structure having a high specific surface area may be formed through an anodization processes of a metal substrate at room temperature, and it is possible to adjust a porosity suitable for having a target permeability and a target permittivity through a pore-widening process.

BRIEF DESCRIPTION OF THE DRAWINGS

FIG. 1 is a schematic view illustrating a process of manufacturing a magnetic-dielectric composite which forms soft magnetic material nanowires in a porous insulating dielectric substrate;

FIG. 2 is a scanning electron microscope (SEM) photograph illustrating an upper surface (surface) of a porous alumina substrate used in the Experimental Example;

FIG. 3 is a scanning electron microscope (SEM) photograph illustrating the cross-section of a porous alumina substrate used in the Experimental Example;

FIG. 4 is a scanning electron microscope (SEM) photograph illustrating a lower surface (bottom surface) of a porous alumina substrate used in the Experimental Example;

FIG. 5 is a scanning electron microscope (SEM) photograph taken after a gold (Au) seed layer is formed by sputtering gold (Au) onto the lower surface of a porous alumina substrate to carry out the electrodeposition;

FIG. 6 is a graph illustrating a change in Fe composition in the $Fe_xCo_{1-x}$ nanowires formed according to the Experimental Example, which is analyzed by a scanning electron microscope (SEM) and the energy dispersive spectroscopy (EDS);

FIG. 7 is a graph of growth rate of $Fe_xCo_{1-x}$ nanowires by a scanning electron microscope (SEM) and the energy dispersive spectroscopy (EDS);

FIG. 8 is a high-magnification scanning electron microscope photograph illustrating the cross-section of a magnetic-dielectric composite manufactured by controlling the composition of $Fe_xCo_{1-x}$ nanowires to x=0.7 to form $Fe_xCo_{1-x}$ nanowires in pores of an alumina substrate;

FIG. 9 is a low-magnification scanning electron microscope photograph illustrating the cross-section of a magnetic-dielectric composite manufactured by controlling the composition of $Fe_xCo_{1-x}$ nanowires to x=0.7 to form $Fe_xCo_{1-x}$ nanowires in pores of an alumina substrate;

FIG. 10 is a scanning electron microscope photograph illustrating the lower surface of an alumina substrate after the composition of $Fe_xCo_{1-x}$ nanowires is controlled to x=0.7 to form $Fe_xCo_{1-x}$ nanowires in pores of the alumina substrate, and then a gold (Au) seed layer is polished by sandpaper;

FIG. 11 is a scanning electron microscope (SEM) photograph of soft magnetic material nanowires remaining after dissolving an insulating dielectric alumina with a 5 M NaOH solution;

FIG. 12 is an X-ray diffraction (XRD) analysis obtained after $Fe_7Co_3$ nanowires are formed in pores of an alumina substrate and before a gold (Au) seed layer on the lower surface of the alumina substrate is polished;

FIG. 13 is an X-ray diffraction (XRD) analysis result after $Fe_7Co_3$ nanowires are formed in pores of an alumina substrate and a gold (Au) seed layer on the lower surface of the alumina substrate is polished;

FIG. 14 is a transmission electron microscope (TEM) illustrating the shape of a $Fe_7Co_3$ nanowire and the selected area electron diffraction (SAED) pattern;

FIG. 15 is a transmission electron microscope (TEM) photograph of a lattice structure of $Fe_7Co_3$ nanowires formed by electrodeposition according to the Experimental Example;

FIG. 16 is a distribution of Fe and Co according to the energy dispersive spectroscopy of $Fe_7Co_3$ nanowires formed by electrodeposition according to the Experimental Example;

FIG. 17 is a graph illustrating the magnetic permeability (μ', μ□) of the real number part and the imaginary number part of a magnetic-dielectric composite manufactured according to the Experimental Example;

FIG. 18 is a graph illustrating the loss of magnetic permeability of a magnetic-dielectric composite manufactured according to the Experimental Example;

FIG. 19 is a graph illustrating the permittivity (ε', ε□) of a magnetic-dielectric composite manufactured according to the Experimental Example; and FIG. 20 is a graph illustrating the loss of permittivity of a magnetic-dielectric composite manufactured according to the Experimental Example.

MODES FOR CARRYING OUT THE PREFERRED EMBODIMENTS

Reference will now be made in detail to the preferred embodiments of the present invention, examples of which are illustrated in the accompanying drawings. It will also be apparent to those skilled in the art that various modifications and variations can be made in the present invention without departing from the spirit or scope of the invention. Thus, it is intended that the present invention cover modifications and variations of this invention provided they come within the scope of the appended claims and their equivalents.

Description will now be given in detail of a drain device and a refrigerator having the same according to an embodiment, with reference to the accompanying drawings.

Hereinafter, preferred Examples of the present invention will be described in detail with reference to the accompanying drawings. However, the following Examples are provided for a person with ordinary skill in the art to fully understand the present invention, and may be modified in various forms, and the scope of the present invention is not limited to the Examples to be described below. Like reference numerals in the drawings denote like elements.

Hereinafter, the nano-size will be used to mean a size of 1 to 1,000 nm as a nanometer unit size. Further, the high frequency will be used to mean 60 Hz or more.

Since a metal-based soft magnetic material such as Fe, Co, Ni, and an alloy of $Fe_xNi_{1-x}$ (X is a real number less than 1), $Fe_xCo_{1-x}$ (X is a real number less than 1), and $Co_xNi_{1-x}$ (X is a real number less than 1) has a large eddy current loss due to the low resistivity, there is a problem in that the permeability is sharply decreased within a quasi-microwave band (1.5 to 3 GHz). Accordingly, an additional process such as coating with oxide in order to minimize the eddy current loss is inevitably designed. However, there are problems in that it is not easy to surround the periphery of a soft magnetic material by an insulating oxide by coating the soft magnetic material with the insulating oxide or depositing the insulating oxide onto the soft magnetic material, the manufacturing process thereof is complicated, the reproducibility deteriorates, the mass production is difficult, the soft magnetic material and the insulating dielectric material are likely to be separated from each other due to a decrease in adhesive force between the soft magnetic material and the insulating dielectric material, and the like.

In the present invention, it is intended to overcome the disadvantages of an existing metal-based soft magnetic material by forming metal-based soft magnetic material nanowires in pores of the insulating dielectric material by means of an electrodeposition method and to develop a material which may be used as a high-frequency antenna for mobile communication in a band of 0.1 to 5 GHz by generating the ferromagnetic resonance (FMR) in a band of 5 GHz or more.

In order to control the permittivity and overcome the eddy current loss, an insulating dielectric substrate in which pores with a nano size are regularly arranged by using the anodizing method is manufactured, and a nano-array formation in which soft magnetic material nanowires fill pores in the insulating dielectric substrate is formed in pores by means of electrodeposition of a metal-based soft magnetic material such as Fe, Co, Ni, or an alloy thereof such as $Fe_xNi_{1-x}$ (X is a real number less than 1)(Permalloy), $Co_xNi_{1-x}$ (X is a real number less than 1), or $Fe_xCo_{1-x}$ (X is a real number less than 1), and the like, thereby manufacturing a magnetic-dielectric composite for a high-frequency antenna substrate, which has optimal permittivity and permeability.

Hereinafter, a magnetic-dielectric composite for a high-frequency antenna substrate and a manufacturing method thereof will be specifically described.

A magnetic-dielectric composite for a high-frequency substrate according to preferred exemplary embodiments of the present invention includes: a porous insulating dielectric substrate including an upper surface, a lower surface, and a side surface and provided with a plurality of pores penetrating the upper surface and the lower surface; and soft magnetic material nanowires provided in the pores, in which the soft magnetic material nanowires are spaced apart from each other while being surrounded by the insulating dielectric substrate.

The magnetic-dielectric composite for a high-frequency antenna substrate is used as an antenna substrate for mobile communication in a high frequency band of 0.1 to 5 GHz.

The soft magnetic material nanowire may be a metal-based soft magnetic material including Fe, Co, Ni, $Fe_xNi_{1-x}$ (X is a real number less than 1), $Fe_xCo_{1-x}$ (X is a real number less than 1), or $Co_xNi_{1-x}$ (X is a real number less than 1).

It is preferred that the pores have an average diameter of 10 to 500 nm, and the soft magnetic material nanowires have an average diameter of 10 to 500 nm.

It is preferred that the insulating dielectric substrate has a thickness between the upper surface and the lower surface of 10 to 300 μm, and a length of the soft magnetic material nanowire is smaller than a thickness of the insulating dielectric substrate.

The insulating dielectric substrate may be a substrate including one or more oxides selected from alumina ($Al_2O_3$), titania ($TiO_2$), zirconia ($ZrO_2$), and niobium oxide ($Nb_2O_5$).

FIG. 1 is a schematic view illustrating a process of manufacturing a magnetic-dielectric composite which forms soft magnetic material nanowires in a porous insulating dielectric substrate.

Referring to FIG. 1, a porous dielectric substrate 100 including an upper surface, a lower surface, and a side surface and provided with a plurality of pores 110 penetrating the upper surface and the lower surface is prepared. It is preferred that the pores 110 has an average diameter of 10 to 500 nm.

The porous insulating dielectric substrate 100 may be a substrate composed of a porous oxide, and a method for forming the porous insulating dielectric substrate 100 will be described with reference to examples.

A metal substrate formed of a material of aluminum (Al), titanium (Ti), zirconium (Zr), and niobium (Nb), and the like is prepared.

A porous oxide (porous oxidation layer) is formed by anodizing the metal substrate. The anodization may be carried out by using the metal substrate as a positive electrode, using an electrode such as platinum, and applying a predetermined voltage (voltage difference between the positive electrode and the negative electrode) (for example, 50 V) to the electrodes while dipping the electrodes in an acidic electrolytic solution (acidic electrolyte), and a porous oxide is formed by the anodization. During the anodization, the positive electrode and the negative electrode are dipped in an acidic electrolytic solution (acidic electrolyte). It is preferred that oxalic acid, phosphoric acid, sulfuric acid, or a mixed solution thereof is used during the anodization of aluminum (Al), hydrofluoric acid, boric acid, sulfuric acid, phosphoric acid, or a mixed solution of phosphoric acid and calcium is used during the anodization of titanium (Ti), boric acid, nitric acid, sulfuric acid, or a mixed solution of sulfuric acid and sodium fluoride is used during the anodization of zirconium (Zr), and sulfuric acid, phosphoric acid, a mixed solution of sulfuric acid and hydrofluoric acid, or a mixed solution of phosphoric acid and hydrofluoric acid is used during the anodization of niobium (Nb). The anodization may be carried out at room temperature.

A metal ion (for example, $Al^{3+}$) oxidized on the surface of the metal substrate and an oxygen ion ($O^{2-}$) decomposed from a water molecule ($H_2O$) of the acidic electrolytic solution (acidic electrolyte) are reacted with each other to form an oxide (oxidation layer). When a metal such as aluminum is oxidized, the metal is converted into a porous structure having pores with a nano size (for example, 10 to 500 nm) by a volume difference occupied by one metal atom. Through the anodization, holes with a nano size are formed vertically from the surface of the substrate while the volume is expanded during the manufacture of a porous insulating dielectric material.

When the anodization time is increased, the thickness of the porous oxidation layer is grown. As the anodization process proceeds, the metal is used up, and when the anodization time is further increased, the metal may be completely converted into an oxide. Since the anodization process is a liquid process which may be carried out at room temperature, there is an advantage in that manufacturing costs may be lowered.

The porous oxide may be subjected to a pore-widening process. For example, the pore-widening process may use a sodium hydroxide (NaOH) solution being an alkaline solution, or phosphoric acid ($H_3PO_4$) or a mixed solution of phosphoric acid and chromic acid ($H_2CrO_4$) being an acidic solution, and the like when the porous oxide is alumina ($Al_2O_3$).

Through the pore-widening process, the porosity of the porous oxide may be adjusted, and the porosity of the porous oxide is increased by the pore-widening process. The longer the pore-widening process time becomes, the larger the size and porosity of pores having a porous structure become. It is preferred that the size of pores after the pore-widening process is 10 to 500 nm in consideration of a diameter of soft magnetic material nanowires formed in pores. It is preferred that the porous oxide has a porosity of 10 to 73% by the pore-widening process.

The porous oxide subjected to the pore-widening process has excellent chemical and mechanical stability, and has a high specific surface area due to the structural characteristics in which pores with a nano size (for example, 10 to 500 nm) are arranged.

It is possible to control the pore size within a range of 10 to 500 nm based on an anodization voltage or a pore-widening process.

As described above, for the insulating dielectric substrate 100 composed of a porous oxide, pores 110 are usually uniformly distributed on the surface (upper surface) and the lower surface (bottom surface) thereof. An insulating dielectric material wall is present between the pore and the pore, the insulating dielectric material wall is formed to have a structure which interrupts the contact between the soft magnetic material nanowires 120 to be formed in the pores 10 by a subsequent electrodeposition process. The porous insulating dielectric substrate 100 serves as a dielectric material which controls the permittivity and simultaneously functions as an insulating material which prevents the eddy current loss of the soft magnetic material.

The pores 110 are covered by forming a seed layer (not illustrated) having electric conductivity on the lower surface (bottom surface) of the porous insulating dielectric substrate 100. It is preferred that the seed layer is formed to have a thickness of 5 to 1,000 nm, and it is preferred that the seed layer uses one or more metals selected from gold (Au), platinum (Pt), silver (Ag), and copper (Cu), which are different from the components of the soft magnetic material nanowires 120. The seed layer may be formed by deposition by means of various methods, and may be formed by using, for example, a sputtering method. For example, a gold (Au) seed layer having a thickness of 5 to 1,000 nm is formed by sputtering gold (Au) onto the lower surface of the porous insulating dielectric substrate 100. The seed layer is formed so as to sufficiently cover pores 110 on the lower surface of the insulating dielectric substrate 100.

Soft magnetic material nanowires 120 are formed in pores 110 of the porous insulating dielectric substrate 100. The soft magnetic material nanowires 120 may be grown and formed by using an electrodeposition method on the seed layer exposed through a plurality of pores 110 on the entire surface of the insulating dielectric substrate 100.

In the present invention, soft magnetic material nanowires 120 are formed in the porous insulating dielectric substrate 100 by using a low-cost wet electrodeposition method. The electrodeposition method is a method capable of synthesizing soft magnetic material nanowires 120 having desired type and composition so as to have a nano-sized diameter with a uniform length by using inexpensive process costs and easy methods. Further, soft magnetic material nanowires 120 having desired diameter, length, and composition may be formed by adjusting pores 110 of the porous insulating dielectric substrate 100, plating conditions, and the like.

The length of the nanowires may be adjusted by depositing a metal-based soft magnetic material such as Fe, Co, Ni, $Fe_xNi_{1-x}$ (X is a real number less than 1), $Fe_xCo_{1-x}$ (X is a real number less than 1), or $Co_xNi_{1-x}$ (X is a real number less than 1) on the pores 110 of the insulating dielectric substrate 100, and adjusting the electrodeposition time.

The electrodeposition may use an electrolytic solution including a soft magnetic material precursor and acid or base. The electrolytic solution may further include an antioxidant such as L-ascorbic acid. The electrodeposition may be carried out by using, for example, a rectifier to apply voltage to a two-electrode or three-electrode system. The seed layer is attached to an working electrode to electrically connect the attached seed layer to a negative electrode, and to connect a counter electrode including a metal which is different from the seed layer and the soft magnetic material to a positive electrode to prepare a two-electrode system (a system including a working electrode and a counter electrode) or a three-electrode system (a system including a working electrode, a counter electrode, and a reference electrode), and a negative voltage is applied to the negative electrode to form soft magnetic material nanowires including Fe, Co, Ni, $Fe_xNi_{1-x}$ (X is a real number less than 1), $Fe_xCo_{1-x}$ (X is a real number less than 1) or $Co_xNi_{1-x}$ (X is a real number less than 1) in pores of an insulating dielectric substrate.

For example, a porous insulating dielectric substrate, in which a seed layer is formed, is adhered to an aluminum foil (the seed layer is adhered so as to be brought into contact with the aluminum foil) by using a silver (Ag) paste, the adhered substrate is used as a working electrode to be connected to a negative electrode, a titanium (Ti) rod coated with platinum is used as a counter electrode to be connected to a positive electrode, an Ag/AgCl electrode is used as a reference electrode, the working electrode, the counter electrode, and the reference electrode are impregnated in an electrolytic solution, a stirring speed is set to 10 to 500 rpm, the electrodeposition temperature is set to room temperature, and a predetermined voltage (for example, −0.9 V to −1.2 V) is applied to a three-electrode system, thereby forming soft magnetic material nanowires in pores of the porous insulating dielectric substrate.

When the soft magnetic material is iron (Fe), the soft magnetic material precursor (Fe precursor) may be iron(II) sulfate heptahydrate ($FeSO_4.7H_2O$), iron(II) chloride tetrahydrate ($FeCl_4.4H_2O$), iron(II) fluoborate, or a mixture thereof, and the like. For example, when soft magnetic material nanowires formed of an iron (Fe) material are to be formed, an electrodeposition may be carried out by using a chloride-sulfate mixture-type electrolytic solution to which iron(II) sulfate heptahydrate ($FeSO_4.7H_2O$), iron(II) chloride tetrahydrate ($FeCl_4.4H_2O$), and ammonium chloride are added, a chloride-type electrolytic solution to which iron(II) chloride tetrahydrate and calcium chloride ($CaCl_2$) are added, a fluoborate-type electrolytic solution to which iron (II) fluoborate, sodium chloride (NaCl), and boric acid are added, and the like as an electrolytic solution.

When the soft magnetic material is cobalt (Co), the soft magnetic material precursor (Co precursor) may be cobalt (II) chloride hexahydrate ($CoCl_2.6H_2O$), cobalt(II) sulfate heptahydrate ($CoSO_4.7H_2O$), or a mixture thereof, and the like. For example, when soft magnetic material nanowires formed of a cobalt (Co) material are to be formed, an electrodeposition may be carried out by using a chloride-type electrolytic solution to which cobalt(II) chloride hexahydrate ($CoCl_2.6H_2O$ and boric acid are added, a sulfate-type electrolytic solution to which cobalt(II) sulfate heptahydrate ($CoSO_4.7H_2O$) and boric acid are added, and the like as an electrolytic solution.

When the soft magnetic material is nickel (Ni), the soft magnetic material precursor (Ni precursor) may be nickel(II) sulfate hexahydrate ($NiSO_4.6H_2O$), nickel(II) chloride hexahydrate ($NiCl_2.6H_2O$), or a mixture thereof, and the like. For example, when soft magnetic material nanowires formed of a nickel (Ni) material are to be formed, an electrodeposition may be carried out by using an electrolytic solution to which nickel(II) sulfate hexahydrate ($NiSO_4.6H_2O$), nickel(II) chloride hexahydrate ($NiCl_2.6H_2O$), and boric acid are added, and the like as an electrolytic solution.

When the soft magnetic material is an alloy of $Fe_xNi_{1-x}$ (X is a real number less than 1), the soft magnetic material precursor may use a mixture of an Fe precursor and a Ni precursor. For example, when soft magnetic material nanowires formed of an alloy material of $Fe_xCo_{1-x}$ (X is a real number less than 1) are to be formed, an electrodeposition may be carried out by using a mixture in which an electrolytic solution including an Fe precursor such as iron(II) sulfate heptahydrate ($FeSO_4.7H_2O$), iron(II) chloride tetrahydrate ($FeCl_4.4H_2O$), and iron(II) fluoborate and an electrolytic solution including a Co precursor such as cobalt(II) chloride hexahydrate ($CoCl_2.6H_2O$) and cobalt(II) sulfate heptahydrate ($CoSO_4.7H_2O$) are mixed as an electrolytic solution. When more specifically examined, for the purpose of electrodeposition, a solution in which iron(II) sulfate heptahydrate, cobalt(II) sulfate heptahydrate, boric acid ($H_3BO_3$), and L-ascorbic acid are mixed is used as an electrolytic solution, the molar ratio of $Fe^{2+}$ and $Co^{2+}$ ions in the electrolytic solution is adjusted to 7:3, 8:2, 9:1, and the like, and the pH of the electrolytic solution is adjusted to 3.0 to 3.1. The boric acid stably maintains the pH, and thus, causes the electrodeposition to more easily occur, and the L-ascorbic acid prevents $Fe^{2+}$ ions from being oxidized into $Fe^{3+}$ ions, and thus, serves as an antioxidant which allows $Fe^{2+}$ ions to take part in the electrodeposition.

When the soft magnetic material is an alloy of $Fe_xCo_{1-x}$ (X is a real number less than 1), the soft magnetic material precursor may use a mixture of an Fe precursor and a Co precursor.

When the soft magnetic material is an alloy of $Co_xNi_{1-x}$ (X is a real number less than 1), the soft magnetic material precursor may use a mixture of a Co precursor and a Ni precursor.

While a soft magnetic material is electrodeposited onto pores 110 in the porous insulating dielectric substrate 100 and grown, soft magnetic material nanowires 120 are formed. It is preferred that the soft magnetic material nanowires 120 are formed to have an average diameter of 10 to 500 nm, and a length of the soft magnetic material nanowires 120 may be formed to be smaller than a depth of the pores 110. During the anodization, it is possible to adjust the size of the pores to 10 to 500 nm by adjusting the applied voltage and the pore-widening process time, and it is possible to adjust the diameter of the nanowires as the size of pores is adjusted. The length of the soft magnetic material nanowires can be adjusted by adjusting the electrodeposition time, and the like.

The soft magnetic material nanowires 120 are surrounded by an insulating dielectric material without being brought into contact with each other, and have a structure capable of minimizing the eddy current loss. The porous insulating dielectric substrate 100 has a form in which the soft magnetic material nanowires 120 fill pores 110 without being brought into contact with each other.

After the electrodeposition, the seed layer is removed by being polished with sandpaper, and the like. The reason for removing the seed layer is because the eddy current loss may be caused when the soft magnetic material nanowires are connected to each other through the seed layer, and accordingly, stable and high permeability and permittivity values cannot be obtained.

Hereinafter, the Experimental Examples according to the present invention will be specifically suggested, and the present invention is not limited by the Experimental Examples to be suggested below.

EXPERIMENTAL EXAMPLES

A porous alumina substrate was used as an insulating dielectric substrate. A porous alumina substrate controlled to have a height of 60 μm and a pore size of 300 nm on average and manufactured by Whatman Inc. was purchased and used.

FIG. 2 is a scanning electron microscope (SEM) photograph illustrating the upper surface (surface) of the porous alumina substrate used in the Experimental Example, FIG. 3 is a scanning electron microscope (SEM) photograph illustrating the cross-section of the porous alumina substrate used in the Experimental Example, and FIG. 4 is a scanning electron microscope (SEM) photograph illustrating the lower surface (bottom surface) of the porous alumina substrate used in the Experimental Example.

Referring to FIGS. 2 to 4, it could be confirmed that pores were usually uniformly distributed through the surface (upper surface) photograph (referring to FIG. 2) and the lower surface (bottom surface) photograph (referring to FIG. 4). In particular, it was confirmed that through the cross-section photograph (referring to FIG. 3), an alumina wall having a thickness of about 200 nm is present between pores and pores, and the alumina wall was formed to have a structure which interrupts the contact between the soft magnetic material nanowires to be formed in the pores by a subsequent electrodeposition process. This results from a mechanism in which holes with a nano size are formed vertically from the surface of the substrate while aluminum is volume-expanded to alumina during the manufacture of an anodizing alumina, and accordingly, it serves as a dielectric material which controls the permittivity of the insulating dielectric substrate and simultaneously functions as an insulating material which prevents the eddy current loss of the soft magnetic material.

In order to carry out the electrodeposition, a gold (Au) seed layer having a thickness of about 400 nm was formed by sputtering gold (Au) onto the lower surface of the porous alumina substrate.

FIG. 5 is a scanning electron microscope (SEM) photograph taken after a gold (Au) seed layer is formed by sputtering gold (Au) onto the lower surface of a porous alumina substrate to carry out the electrodeposition.

Referring to FIG. 5, a gold (Au) seed layer having a thickness of about 400 nm was formed by sputtering gold (Au) onto the lower surface (bottom surface) of the alumina substrate.

$Fe_xCo_{1-x}$ (X is a real number less than 1) nanowires were formed in pores of a porous alumina substrate by an electrodeposition method. For the purpose of electrodeposition, a solution in which 48.5 mM of which iron(II) sulfate heptahydrate, cobalt(II) sulfate heptahydrate, and boric acid ($H_3BO_3$), and 2 g/L of L-ascorbic acid were mixed was used as an electrolytic solution. The molar ratio of $Fe^{2+}$ and $Co^{2+}$ ions in the electrolytic solution was adjusted to 7:3, 8:2, and 9:1 by fixing the concentration of cobalt(II) chloride heptahydrate at 42.7 mM and increasing the concentration of iron(II) sulfate heptahydrate to 99.6, 170.9, and 384.3 mM. The pH of the electrolytic solution was adjusted between 3.0 and 3.1. At this time, the added boric acid stably maintains the pH, and thus, causes the electrodeposition to more easily occur, and the L-ascorbic acid prevents $Fe^{2+}$ ions from being oxidized into $Fe^{3+}$ ions, and thus, serves as an antioxidant which allows $Fe^{2+}$ ions to take part in the electrodeposition.

A porous alumina substrate, in which a gold (Au) seed layer was formed, was adhered to an aluminum foil (99%, 0.25 mm, Alfa Aesar) by using a silver (Ag) paste (Pelco Colloidal silver paste, Ted Pella, Inc.) (the gold seed layer was adhered so as to be brought into contact with the aluminum foil), and the adhered porous alumina substrate was used as a working electrode to be connected to a negative electrode. A titanium (Ti) rod coated with platinum having a thickness of 1.5 μm was used as a counter electrode to be connected to a positive electrode, and an Ag/AgCl (sat. KCl) electrode was used as a reference electrode. During the electrodeposition, a stirring speed of the electrolytic solution was set to 200 rpm, and the electrodeposition temperature was set to room temperature.

$Fe_xCo_{1-x}$ nanowires were formed in pores of a porous alumina substrate by applying a voltage of −0.9 V to −1.2 V to a three-electrode cell prepared as described above.

The gold (Au) seed layer was electrodeposited, and then removed by being polished with sandpaper.

As a method for manufacturing a magnetic-dielectric composite according to the Experimental Example, an anodization method and an electrodeposition method capable of being processed at room temperature were used, and optimally applied direct current voltage and electrolytic solution composition were established, thereby obtaining permittivity and permeability of 3 or more.

FIG. 6 is a graph illustrating a result that a change in Fe composition in the $Fe_xCo_{1-x}$ nanowires formed according to the Experimental Example is analyzed by a scanning electron microscope (SEM) and the energy dispersive spectroscopy (EDS).

FIG. 7 is a growth rate graph of exposed $Fe_xCo_{1-x}$ nanowires by a scanning electron microscope (SEM) and the energy dispersive spectroscopy (EDS).

Referring to FIGS. 6 and 7, as the Fe fraction in the electrolytic solution and the applied voltage were increased, the content of Fe in the nanowires was increased from 47% to 77%. Through the growth rate graph illustrated in FIG. 7, it was exhibited that as the applied voltage was increased, the growth rate was sharply increased from 1 μm/h to 14 μm/h, and the uniformity was decreased.

FIG. 8 is a high-magnification scanning electron microscope photograph illustrating the cross-section of a magnetic-dielectric composite manufactured by controlling the composition of $Fe_xCo_{1-x}$ nanowires to x=0.7 to form $Fe_xCo_{1-x}$ nanowires in pores of an alumina substrate, FIG. 9 is a low-magnification scanning electron microscope photograph illustrating the cross-section of a magnetic-dielectric composite manufactured by controlling the composition of $Fe_xCo_{1-x}$ nanowires to x=0.7 to form $Fe_xCo_{1-x}$ nanowires in pores of an alumina substrate, FIG. 10 is a scanning electron microscope photograph illustrating the lower surface of an alumina substrate after the composition of $Fe_xCo_{1-x}$ nanowires is controlled to x=0.7 to form $Fe_xCo_{1-x}$ nanowires in pores of the alumina substrate, and then a gold (Au) seed layer is polished by sandpaper, and FIG. 11 is a scanning electron microscope (SEM) photograph of soft magnetic material nanowires remaining after dissolving alumina being an insulating dielectric material with a 5 M NaOH solution taken. In the $Fe_xCo_{1-x}$ nanowires, the saturation magnetization value varies depending on the relative composition ratio, $Fe_7Co_3$ (x=0.7) exhibits the highest saturation magnetization value, an electrolytic solution, in which 42.7 mM of cobalt(II) chloride heptahydrate, 100.7 mM of iron(II) sulfate heptahydrate, 48.5 mM of boric acid, and 2 g/L of L-ascorbic acid were mixed, was used in consideration of the highest saturation magnetization value, and $Fe_7Co_3$ nanowires were formed by means of an electrodeposition method by applying a voltage of −1.2 V to the electrolytic solution for 5 hours.

Through the high-quality cross-sectional photograph in FIG. 8, it could be confirmed that the $Fe_7Co_3$ nanowires were surrounded by an insulating dielectric material (alumina) without being brought into contact with each other. This exhibits that the structure is a structure capable of minimizing the eddy current loss as described with reference to FIGS. 6 and 7.

Through FIGS. 9 and 10, it can be confirmed that the soft magnetic materials ($Fe_7Co_3$) fill pores without being brought into contact with each other in a porous alumina substrate having a thickness of about 60 μm. The length of the $Fe_7Co_3$ nanowires is about 55 μm, and is a value which may be adjusted by adjusting the electrodeposition time.

FIG. 11 is a photograph of soft magnetic material nanowires remaining after dissolving alumina being an insulating dielectric material with a 5 M sodium hydroxide (NaOH) solution taken, and the average diameter of the nanowires was measured as 307.38 nm. During the anodization, it is possible to adjust the size of the pores to 10 to 500 nm by adjusting the applied voltage and the pore-widening process time, and it is possible to adjust the diameter of the nanowires as the size of pores is adjusted.

FIG. 12 is an X-ray diffraction (XRD) analysis result before $Fe_7Co_3$ nanowires are formed in pores of an alumina substrate and a gold (Au) seed layer on the lower surface of the alumina substrate is polished, and FIG. 13 is an X-ray diffraction (XRD) analysis result after $Fe_7Co_3$ nanowires are formed in pores of an alumina substrate and a gold (Au) seed layer on the lower surface of the alumina substrate is polished.

FIG. 12 is an X-ray diffraction analysis result of a magnetic-dielectric composite including a gold (Au) seed layer (refer to (a) in FIG. 12), and includes all of the $Fe_7Co_3$ (JCPDS #48-1817) peaks (110, 200, and 211 peaks) and gold (JCPDS #04-0784) peaks (111, 200, 220, 311, and 222 peaks) to be shown below. FIG. 13 is an analysis result after the gold (Au) seed layer is removed, and since the gold (Au) peaks were cleanly removed, it could be confirmed that a magnetic-dielectric composite (refer to (a) in FIG. 13) in which the inside of the insulating dielectric material was filled with the soft magnetic material nanowires was formed well, and the $Fe_7Co_3$ nanowires formed by electrodeposition has a body centered cubic (BCC) structure in which the nanowires are preferentially arranged in the <110> direction. The reason that polycrystalline peaks appeared in the X-ray diffraction (XRD) analysis in FIG. 13 seems to be because the diameter of the nanowires was relatively thick, and as a result, the (200) and (211) texturing partially occurred.

FIG. 14 is a transmission electron microscope (TEM) illustrating the shape of a $Fe_7Co_3$ nanowire a selected area electron diffraction (SAED) pattern, FIG. 15 is a transmission electron microscope (TEM) photograph of a lattice structure of $Fe_7Co_3$ nanowires formed by electrodeposition according to the Experimental Example taken, and FIG. 16 is a distribution view of Fe and Co according to the energy dispersive spectroscopy of $Fe_7Co_3$ nanowires formed by electrodeposition according to the Experimental Example.

As illustrated in FIG. 14, it could be confirmed that the diameter of the nanowires was shown to be about 300 nm in thickness as described in FIG. 11, and the nanowires were arranged in the BCC <110> direction through the inserted SAED pattern. As a result of the lattice structure analysis illustrated in FIG. 15, the distance between lattices was 0.286 nm, and coincides with a=0.286 nm of the BCC structure which can be confirmed in accordance with the JCPDS #48-1817. Further, through FIG. 16, it could be confirmed that Fe and Co were uniformly distributed in the nanowires.

FIG. 17 is a graph illustrating the permeability (μ', μ□) of the real number part and the imaginary number part of a magnetic-dielectric composite manufactured according to the Experimental Example, FIG. 18 is a graph illustrating the permeability loss of a magnetic-dielectric composite manufactured according to the Experimental Example, FIG. 19 is a graph illustrating the permittivity (ε', ε□) of a magnetic-dielectric composite manufactured according to the Experimental Example, and FIG. 20 is a graph illustrating the permittivity loss of a magnetic-dielectric composite manufactured according to the Experimental Example.

Referring to FIGS. 17 to 20, a test specimen cut into a rectangular film form was disposed at the center of the lower line ground line of a ground line disposed at a site with the same height above and below the center signal line by introducing a microstrip line (MSL)-based symmetric MSL measurement system. The in-situ s-parameter value in the atmosphere was measured by connecting a 8510C vector network analyzer manufactured by HP Agilent Technologies to the test specimen. The permeability of the magnetic-dielectric composite all has a value of 3 or more in the measured frequency band, the permeability loss tangent was measured as less than 0.04, and the permittivity also has a value of 3 or more and the permittivity loss tangent has a value of about 0.01. It was confirmed that a resonance frequency region did not appear in a frequency band of 0.1 to 5 GHz, which is a measurement range. Therefore, it is expected for the magnetic-dielectric composite to exhibit a stable and high efficiency as a material for an antenna substrate which is driven in a frequency band (0.1 to 5 GHz) of 5 GHz or less.

Although preferred Examples of the present invention have been described in detail above, the present invention is not limited to the Examples, and can be modified in various forms within the scope of the technical spirit of the present invention by those skilled in the art.

EXPLANATION OF REFERENCE NUMERALS AND SYMBOLS

100: Insulating dielectric substrate

110: Pore

120: Soft magnetic material nanowire

The invention claimed is:

1. A magnetic-dielectric composite for a high-frequency antenna substrate, the magnetic-dielectric composite comprising:

a porous insulating dielectric substrate comprising an upper surface, a lower surface, and a side surface and provided with a plurality of pores penetrating the upper surface and the lower surface; and soft magnetic material nanowires provided in the pores, wherein the soft magnetic material nanowires are surrounded by the porous insulating dielectric substrate to be apart from each other.

2. The magnetic-dielectric composite of claim 1, wherein the magnetic-dielectric composite for a high-frequency antenna substrate is used as an antenna substrate for mobile communication in a high frequency band of 0.1 to 5 GHz.

3. The magnetic-dielectric composite of claim 1, wherein the soft magnetic material nanowire is a metal-based soft magnetic material comprising Fe, Co, Ni, $Fe_xNi_{1-x}$ (X is a real number less than 1), $Fe_xCo_{1-x}$ (X is a real number less than 1), or $Co_xNi_{1-x}$ (X is a real number less than 1).

4. The magnetic-dielectric composite of claim 1, wherein the pores have an average diameter of 10 to 500 nm, and the soft magnetic material nanowires have an average diameter of 10 to 500 nm.

5. The magnetic-dielectric composite of claim 1, wherein the porous insulating dielectric substrate has a thickness between the upper surface and the lower surface of 10 to 300 μm, and a length of the soft magnetic material nanowire is smaller than a thickness of the porous insulating dielectric substrate.

6. The magnetic-dielectric composite of claim 1, wherein the porous insulating dielectric substrate is a substrate comprising one or more oxides selected from alumina ($Al_2O_3$), titania ($TiO_2$), zirconia ($ZrO_2$), and niobium oxide ($Nb_2O_5$).

7. A method for manufacturing a magnetic-dielectric composite for a high-frequency antenna substrate, the method comprising:

preparing a porous insulating dielectric substrate comprising an upper surface, a lower surface, and a side surface and provided with a plurality of pores penetrating the upper surface and the lower surface;

forming a seed layer having electric conductivity on the lower surface of the porous insulating dielectric substrate to cover the plurality of pores on the lower surface;

growing to form soft magnetic material nanowires on the seed layer exposed through a plurality of pores of the entire surface of the porous insulating dielectric substrate by electrodeposition; and removing the seed layer, wherein the soft magnetic material nanowires are surrounded by the porous insulating dielectric substrate to be apart from each other.

8. The method of claim 7, wherein the preparing of the porous insulating dielectric substrate comprises:

anodizing one or more metal substrates selected from aluminum (Al), titanium (Ti), zirconium (Zr), and niobium (Nb) to form a substrate comprising one or more oxides selected from porous alumina ($Al_2O_3$), titania ($TiO_2$), zirconia ($ZrO_2$), and niobium oxide ($Nb_2O_5$); and wherein oxalic acid, phosphoric acid, sulfuric acid, or a mixture thereof is used when anodizing aluminum (Al);

hydrofluoric acid, boric acid, sulfuric acid, phosphoric acid, or a mixture of phosphoric acid and calcium is used when anodizing titanium (Ti);

boric acid, nitric acid, sulfuric acid, or a mixture of sulfuric acid and sodium fluoride is used when anodizing zirconium (Zr); and sulfuric acid, phosphoric acid, a mixture of sulfuric acid and hydrofluoric acid, or a mixture of phosphoric acid and hydrofluoric acid is used when anodizing niobium (Nb).

9. The method of claim 7, further comprising:

widening the pores of the porous insulating dielectric substrate, wherein the porous insulating dielectric substrate is a substrate comprising one or more oxides selected from alumina ($Al_2O_3$), titania ($TiO_2$), zirconia ($ZrO_2$), and niobium oxide ($Nb_2O_5$); and the pore-widening provides the pores of the porous insulating dielectric substrate to have a size of 10 to 500 nm.

10. The method of claim 9, wherein the pore-widening is carried out by dipping the porous insulating dielectric substrate in a sodium hydroxide (NaOH) solution, a phosphoric acid ($H_3PO_4$) solution, or the mixture of phosphoric acid ($H_3PO_4$) and chromic acid ($H_2CrO_4$) where the porous insulating dielectric substrate is a substrate comprising alumina ($Al_2O_3$), and the pore-widening provides the porous insulating dielectric substrate to have a porosity of 10 to 73% by the pore-widening.

11. The method of claim 7, wherein the soft magnetic material nanowire is a metal-based soft magnetic material comprising Fe, Co, Ni, $Fe_xNi_{1-x}$ (X is a real number less than 1), $Fe_xCo_{1-x}$ (X is a real number less than 1), or $Co_xNi_{1-x}$ (X is a real number less than 1).

12. The method of claim 11, wherein the electrodeposition uses an electrolytic solution comprising a soft magnetic material precursor, and an acid or a base;

iron(II) sulfate heptahydrate ($FeSO_4.7H_2O$), iron(II) chloride tetrahydrate ($FeCl_4.4H_2O$), iron(II) fluoborate, or a mixture thereof as an Fe precursor;

cobalt(II) chloride hexahydrate ($CoCl_2.6H_2O$), cobalt(II) sulfate heptahydrate ($CoSO_4.7H_2O$), or a mixture thereof as a Co precursor;

nickel(II) sulfate hexahydrate ($NiSO_4.6H_2O$), nickel(II) chloride hexahydrate ($NiCl_2.6H_2O$), or a mixture thereof as a Ni precursor;

the seed layer is attached to a working electrode whereby electrically connecting the attached seed layer to a negative electrode, and connecting a counter electrode including a metal which is different from the seed layer and the soft magnetic material to a positive electrode; and a negative voltage is applied to the negative electrode to form the soft magnetic material nanowires including Fe, Co, Ni, $Fe_xNi_{1-x}$ (X is a real number less than 1), $Fe_xCo_{1-x}$ (X is a real number less than 1) or $Co_xNi_{1-x}$ (X is a real number less than 1) in the pores of the porous insulating dielectric substrate.

13. The method of claim 7, wherein the pores are formed to have an average diameter of 10 to 500 nm, and the soft magnetic material nanowires provided in the pores are formed to have an average diameter of 10 to 500 nm.

14. The method of claim 7, wherein the porous insulating dielectric substrate has a thickness between the upper surface and the lower surface of 10 to 300 μm, and a length of the soft magnetic material nanowire is formed to be smaller than a thickness of the porous insulating dielectric substrate.

15. The method of claim 7, wherein the seed layer is formed to have a thickness of 5 to 1,000 nm, and the seed layer uses one or more metals selected from gold (Au), platinum (Pt), silver (Ag), and copper (Cu), which are different from components of the soft magnetic material nanowires.

16. The magnetic-dielectric composite of claim 1, wherein holes are formed vertically from one of the upper surface and the lower surface of the porous insulating dielectric substrate.

17. The magnetic-dielectric composite of claim 1, wherein the soft magnetic material nanowires are apart from each other by about 200 nm.

18. The magnetic-dielectric composite of claim 1, wherein the soft magnetic material nanowires have a length of about 55 μm.

19. The method of claim 7, wherein holes are formed vertically from one of the upper surface and the lower surface of the porous insulating dielectric substrate.

20. The method of claim 7, wherein the soft magnetic material nanowires are apart from each other by about 200 nm, and have a length of about 55 μm.

* * * * *